United States Patent [19]

Lindsey

[11] Patent Number: 4,709,125

[45] Date of Patent: Nov. 24, 1987

[54] STRAIN INSULATOR WITH ARCING HORNS

[75] Inventor: Keith E. Lindsey, La Canada, Calif.

[73] Assignee: Lindsey Manufacturing Company, Azusa, Calif.

[21] Appl. No.: 1,394

[22] Filed: Jan. 8, 1987

[51] Int. Cl.[4] ..... H01B 17/46

[52] U.S. Cl. ..... 174/140 S; 174/184; 361/137

[58] Field of Search ..... 174/140 R, 140 S, 141 R, 174/181, 183, 184, 207; 361/132, 137, 138

[56] References Cited

U.S. PATENT DOCUMENTS

| | | | |
|---|---|---|---|
| 1,270,457 | 6/1918 | Steinberger | 361/132 X |
| 1,337,284 | 4/1920 | Sonneborn | 361/132 X |
| 1,448,773 | 3/1923 | Springer | 361/132 |
| 4,531,018 | 7/1985 | Huster | 361/137 X |

FOREIGN PATENT DOCUMENTS

| | | | |
|---|---|---|---|
| 585888 | 10/1933 | Fed. Rep. of Germany | 174/141 R |
| 1297207 | 6/1969 | Fed. Rep. of Germany | 174/140 R |
| 1200231 | 6/1959 | France | 361/137 |
| 1204720 | 8/1959 | France | 174/141 R |
| 566355 | 8/1957 | Italy | 174/141 R |

*Primary Examiner*—Laramie E. Askin

*Attorney, Agent, or Firm*—Christie, Parker & Hale

[57] ABSTRACT

A combined strain insulator and arcing horn assembly. The arcing horns comprise a pair of rods having V-shaped outer ends criss crossing one another along one lateral side of the insulator and arranged to form multiple self-extinguishing wiring gaps emanating from the common gap between the spaced apart apexes thereof. The assembly is eminently suited for installation vertically, horizontally or in an inclined position. The hardware components are identical and integral except for fasteners.

14 Claims, 3 Drawing Figures

STRAIN INSULATOR WITH ARCING HORNS

This invention relates to high tension strain insulators, and more particularly to a unique strain insulator having a set of arcing horns so constructed and arranged as to provide multiple self-extinguishing arcing gaps uniquely arranged for high efficiency operation in many positions of the insulator including vertical, horizontal and intermediate positions.

BACKGROUND OF THE INVENTION

Various proposals have been made heretofore for strain insulators equipped with arcing horns to protect a high tension line and the insulator itself if a flashover occurs across the insulator. Such flashovers can arise from numerous causes including abnormal operating conditions on the line, a lightning strike, damage to the insulator caused by impact with foreign objects, and the collection of a coating on the insulator due to environmental conditions. Serious results can follow unless the insulator is provided with a protective device such as an arcing horn. Typically, such horns comprise an accessory clampable to the insulator or to its terminal hardware and disposed to provide a conductive path for the arc suitably spaced from the surface of the insulator. The proper functioning of such horns is dependent on the care with which they are secured to the insulators and adjusted to provide a desired arcing gap. The gap adjustment may be disturbed during installation or may be improperly made at the time of installation. The mounting devices add to the cost of the insulator assembly and this is further increased by the charge involved in adjusting and setting the arcing gap. A further and important shortcoming of prior insulators equipped with arcing horns is their lack of versatility to meet the needs of differing operating environments and their disposition relative to horizontal and vertical planes. It is important that the horns diverge upwardly away from a horizontal plane so as to be automatically self-extinguishing. This need is easily satisfied if the insulator axis is generally horizontal; however this need may not be satisfied if the insulator is installed sharply inclined to the horizontal.

SUMMARY OF THE INVENTION

The strain insulator provided by this invention avoids the foregoing and other disadvantages of prior constructions and provides a simplified rugged construction formed of three main components rigidly interlocked in a predetermined high efficiency relationship. The two horns are integral with a respective eyebolt or clevis, the interlooped bight portions of which are imbedded in high strength insulation material with their planes lying at right angles to one another and with their legs projecting from the opposite ends of the insulator. The two horns span one lateral side of the insulator and are bent to provide respective V-shaped portions with their apexes appropriately spaced to form a desired arcing gap. Preferably but not necessarily, the V-shaped legs of each horn diverge at a 120 degree angle and the legs of the two end portions span another 60 degree arcing gap. In consequence, the two horns form three self-extinguishing arcing gaps emanating from the single gap between their respective apexes. Additionally, and when installed in any of many positions, the three arcing gaps lie in upwardly inclined planes generally midway between the planes containing the respective insulator hardware. Accordingly, so long as the workman installs the insulator with the horns inclined upwardly from the horizontal, the insulator and its arcing horns function equally efficiently and in a fool proof manner irrespective of whether the insulator is installed in a horizontal or vertical line or in one inclined to the horizontal.

Accordingly, it is a primary object of this invention to provide a strain insulator with unique multiple self-extinguishing arcing horns.

Another object of the invention is the provision of a strain insulator having self-extinguishing arcing horns integral with the insulator installation hardware.

Another object of the invention is the provision of a strain insulator having a set of arcing horns so constructed and arranged as to provide multiple arcing gaps each diverging differently relative to the longitudinal axis of the insulator.

Another object of the invention is the provision of a strain insulator having a pair of arcing horns integral with the insulator mounting hardware and forming more than one self-extinguishing arcing gap disposed to one lateral side of the insulator and inclined to both horizontal and vertical planes intersecting along the insulator axis.

These and other more specific objects will appear upon reading the following specification and claims and upon considering in connection therewith the attached drawing to which they relate.

Referring now to the drawing in which a preferred embodiment of the invention is illustrated:

Figure 1:
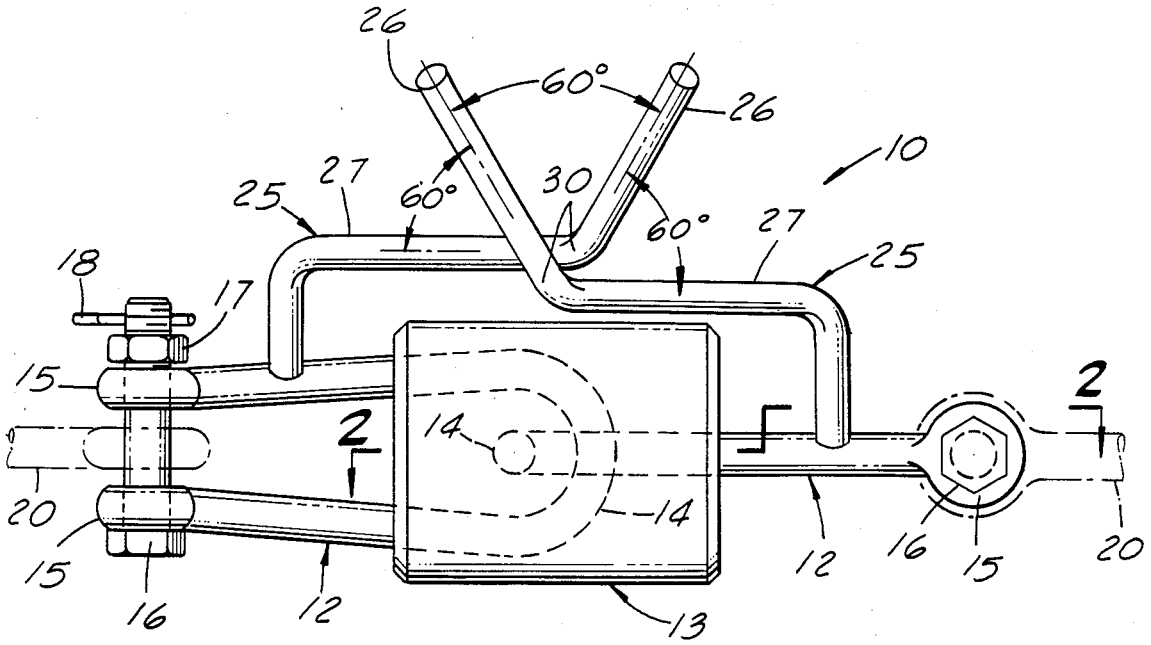
FIG. 1 is a side elevational view of an illustrative embodiment of my strain insulator.
Figure 2:
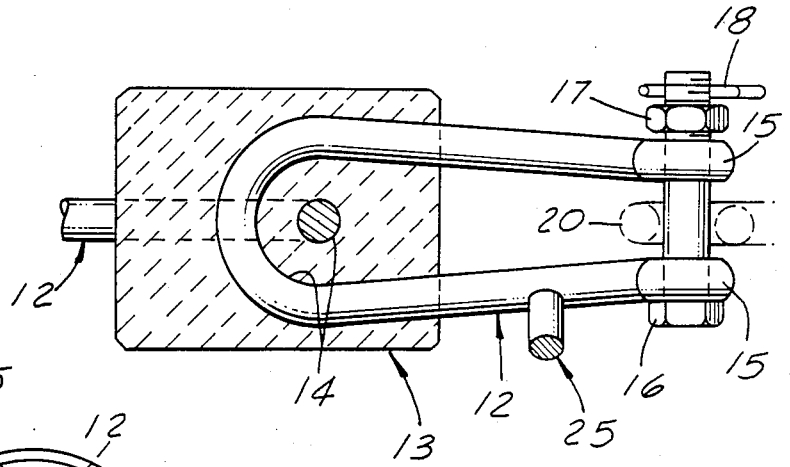
FIG. 2 is a cross sectional view taken along line 2—2 on FIG. 1.
Figure 3:
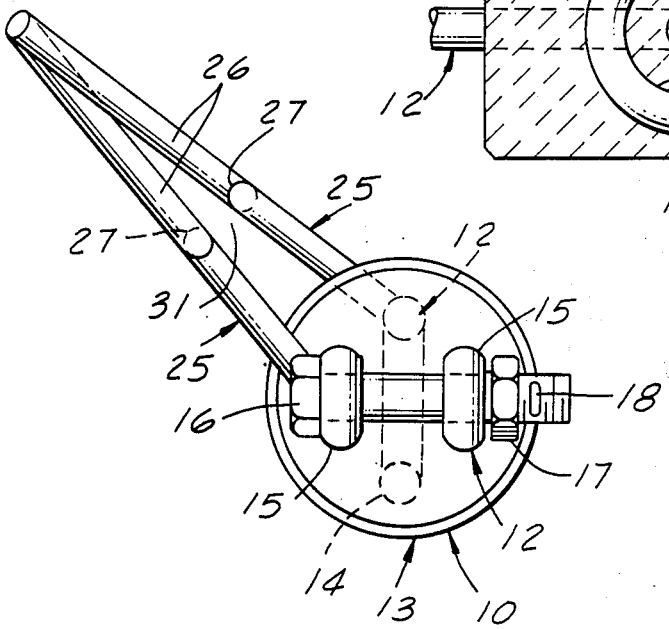
FIG. 3 is an end elevational view from the right hand end of FIG. 1.

The strain insulator and self-extinguishing arcing horn assembly, designated generally 10, comprises a pair of heavy duty hardware components 12, 12 having spaced apart interlooped portions thereof embedded in and extending in opposite directions from high strength insulation material 13. The interlooped hardware members 12, 12 may comprise eye bolts with their interlooped eye portions embedded in the strain insulator. As herein shown by way of example, the hardware members 12, 12 comprise clevises with their bight portions 14 in spaced apart and interlooped relation and lying in planes at right angles to one another lengthwise of insulator 13. The legs of each clevis terminate in small diameter rings 15, 15 seating separate bolts 16 held in assembled position by a nut 17 and a cotter pin 18. Bolts 16 serve to connect insulator assembly 10 between the adjacent ends of cabling 20, 20. Typically, such cabling is connected to or structurally associated with the neutral conductor of a high tension power line or to dead end anchoring means for such cabling. In certain operating environments the strain insulators lie in a generally horizontal plane while in others they are used in a suspension assembly wherein the insulator lies in a generally vertical postion. These are merely typical.

The insulation material 13 is formed of suitable high tensile strength material, a particularly suitable material being known to persons skilled in this art and available on the market under the trademark POLYSIL. A ⅛ inch thick piece of this material has a dielectric constant of 400 volts per mil; an arc resistant factor of at least 240 seconds; a differential wet-track index of 11.0 w-min.; a dielectric constant at 60 hertz of 4.3 to 4.5; a dissipation factor of 0.013 to 0.033; a volume resistivity of 2 times $10^{15}$ ohms per centimeter; a surface withstand stress level of 0.9 to 1.3 KV per inch; a splitting tensile strength of 3200 psi; a compressive strength of 22,000 psi and a modulus of rupture of 7000 psi.

A highly important feature of the insulator assembly is the provision of self-extinguishing arcing horns 25, 25 having their inner ends integral with a respective external portion of the hardware members 12, 12. The outer ends of these horns are V-shaped and formed by identical legs 26, 27. As herein shown by way of example, legs 26 and 27 span an included angle of 120 degrees. The legs 27 lie generally parallel to one another and are suitably spaced outwardly from one exterior lateral side of insulator 13. It follows from the foregoing that the center lines of legs 26, 26 are approximately 60 degrees apart and each leg 26 of one horn lies at an angle of approximately 60 degrees to leg 27 of the other horn. The apex portions 30 of the horns are spaced apart to form an arcing gap 31 which breaks down to form an electrical arc when the cabling 20, 20 in which the insulator is mounted is subjected to an abnormally high voltage such as might be caused by lightning, the operation of circuit breakers serving the power line, or some other abnormal condition.

The formation of such an arc taking place between the heavy duty metallic horn components safeguards the insulator itself from damage and becomes gradually self-extinguishing as it rises automatically along the horn legs and collapses in accordance with principles well know to persons skilled in this art. The arc initiates in gap 31 and typically climbs upwardly between that particular set of horns uppermost with respect to gap 31. If the insulator is in a generally horizontal position. the arc will climb between the legs 26, 26 until it extinguishes. However, if the insulator is inclined downwardly to the right as viewed in FIG. 1, the left hand legs 26, 27 will be best positioned to support the arc as it expands from gap 31 to the point of collapse and extinction.

From the foregoing it will be apparent that the insulator 10 is unusually versatile and mountable in a wide variety of positions without regard to which end is uppermost, care merely being exercised to locate the arcing horns above the insulator axis when installed in an inclined position. The fact that each horn lies generally in a radial plane passing through the axis of the insulator and inclined about 45 degrees to the embedded loop portion thereof results in these elements being identical.

While the particular strain insulator with arcing horns herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A strain insulator comprising:

a pair of similar elongated metallic terminal members extending in opposite directions and having adjacent ends interlooped and embedded in and isolated from one another by high strength insulation;

an arcing horn assembly bridging said insulation along one side thereof comprising a pair of metallic rods having one end of each connected to a respective one of said terminal members outwardly of the adjacent end of said insulation, the other ends of said rods being V-shaped with the apex portions thereof in spaced apart proximity to form an arcing gap and with a corresponding leg of each one thereof diverging upwardly away from one another to render said arcing gap self-extinguishing.

2. A strain insulator as defined in claim 1 characterized in that the legs of the V-shaped ends of each of said rods diverge from one another at an angle in excess of 90 degrees, and the outermost leg of said V-shaped ends lies generally midway between the legs of the other V-shaped rod end.

3. A strain insulator as defined in claim 1 characterized in that said V-shaped ends of said rods are constructed and arranged to form a plurality of self-extinguishing arcing gaps each having a pair of legs diverging in a different direction.

4. A strain insulator as defined in claim 3 characterized in that said V-shaped ends of said rods are constructed and arranged to form three self-extinguishing arcing gaps.

5. A strain insulator as defined in claim 4 characterized in that said self-extinguishing arcing gaps are generally similar to one another and at least one of which is adapted to diverge upwardly between horizontal and vertical planes intersecting one another along the longitudinal axis of said insulator when properly installed in an operating environment.

6. A strain insulator as defined in claim 1 characterized in that said terminal members comprise clevises having their bight portions interlooped and lying generally in planes at right angles to one another.

7. A strain insulator as defined in claim 6 characterized in that one end of each rod of said arcing horn assembly, is integral with a leg of a respective one of said clevises.

8. A strain insulator comprising:

a main body of high strength insulation equipped at the opposite ends thereof with a pair of metallic cable connector means having, a portion of each one thereof embedded therein;

a pair of arcing horns each attached to a respective one of said connector means exteriorly of a respective end of said main body and having V-shaped outer end portions criss-crossing, one another along one lateral side of said main body with the apexes thereof being spaced apart to form a self-extinguishing arcing gap diverging upwardly and outwardly away from said main body.

9. A strain insulator as defined in claim 8 characterized in that said criss-crossing portions of said arcing horns are constructed and arranged to form a plurality of upwardly diverging arcing gaps.

10. A strain insulator as defined in claim 8 characterized in that said criss-crossing portions of said arcing horns are constructed and arranged to form three generally similar self-extinguishing arcing gaps.

11. A strain insulator as defined in claim 8 characterized in that each one of said pair of cable connector means is formed in one integral piece.

12. A strain insulator as defined in claim 11 characterized in that said cable connector means comprise a pair of clevises having their bight portions interlooped and embedded in spaced apart relation in said main body.

13. A strain insulator as defined in claim 11 characterized in that said pair of arcing horns lie generally in a radial plane containing the longitudinal axis of said main body and lying generally midway between the planes of said clevises.

14. A strain insulator as defined in claim 8 characterized in that said embedded portions of said cable connector means are interlooped in spaced apart relation.

* * * * *